United States Patent [19]

Fujiwara et al.

[11] Patent Number: 4,481,033

[45] Date of Patent: Nov. 6, 1984

[54] HIGH MN-CR NON-MAGNETIC STEEL

[75] Inventors: Kazuo Fujiwara, Kobe; Kiyoshi Sugie, Akashi; Fujiko Uetani, Kobe, all of Japan

[73] Assignee: Kabushiki Kaisha Kobe Seiko Sho, Kobe, Japan

[21] Appl. No.: 364,871

[22] Filed: Apr. 2, 1982

[30] Foreign Application Priority Data

Apr. 3, 1981 [JP] Japan ..... 56-50203
Apr. 3, 1981 [JP] Japan ..... 56-50204

[51] Int. Cl.[3] ..... C22C 38/40

[52] U.S. Cl. ..... 75/128 A; 75/128 N; 75/128 V

[58] Field of Search ..... 75/128 A, 126 B, 128 G, 75/128 Z, 128 T, 128 V, 128 N; 148/37, 12 E, 12 EA

[56] References Cited

U.S. PATENT DOCUMENTS 2,789,048 4/1957 DeLong et al. ..... 75/126 B
3,112,195 11/1963 Souresny ..... 75/128 A
3,151,979 10/1964 Carney et al. ..... 75/128 A
3,629,760 12/1971 Seitanakis ..... 75/128 A
3,847,599 11/1974 Hartline ..... 75/126 B

FOREIGN PATENT DOCUMENTS 1321784 2/1963 France ..... 75/128 A
756993 9/1956 United Kingdom .
902440 8/1962 United Kingdom .
1595707 8/1981 United Kingdom .

*Primary Examiner*—L. Dewayne Rutledge
*Assistant Examiner*—Debbie Yee
*Attorney, Agent, or Firm*—Oblon, Fisher, Spivak, McClelland & Maier

[57] ABSTRACT

High Mn-Cr non-magnetic steel having good resistance to stress corrosion cracking, which consists essentially of the following elements in percentage by weight:
0.05–0.18% of carbon;
up to 1.0% of silicon;
16–25% of manganese;
14–17% of chromium;
0–0.8% of vanadium
0.3–0.6% of nitrogen;
0.06–0.3% of nickel; and
the balance of iron and inevitable impurities.

3 Claims, 6 Drawing Figures

HIGH MN-CR NON-MAGNETIC STEEL

BACKGROUND OF THE INVENTION (1) Field of the Invention

This invention relates to a high Mn-Cr non-magnetic steel with good resistance to stress corrosion cracking (hereinafter referred to as "SCC" for brevity), and more particularly to a high Mn-Cr non-magnetic steel suitable for use as a material for retainer rings of power generator rotors.

(2) Description of Prior Art

Generally, the retainer rings for generator rotors are required to be non-magnetic to prevent drops in the efficiency of power generation. In addition, the material for the rotor retainer ring is required to meet demands for strength to cope with increases in the capacity of power generators. For example, in the case of an atomic power plant, a rotor with a winding assembly therearound is put in high speed rotation while feeding cooling water to conduits in rotor bearings to avoid overheating. The rotor is accommodated in a stator which is filled with hydrogen gas or air and contacted with cooling water to deprive of its radiation heat.

The cylindrical retainer rings which are fitted on the bearings at the opposite ends of the rotor are cooled in a similar manner. The retainer rings are usually formed of a non-magnetic material, mainly from 18Mn-5Cr steel from the standpoint of preventing drops in the efficiency of power generation by the production of eddy current. This kind of steel has a high strength but suffers from a problem in that it becomes susceptible to stress corrosion cracking during repeated use over a long time period. Although the cause of this problem has not yet been cleared completely, it has been confirmed by experiments that the resistance to stress corrosion cracking is lowered considerably by moisture deposition. In this connection, although the retainer rings are not cooled by direct contact with cooling water in the actual generator as mentioned above, there are possibilities of the hydrogen gas or moisture content in air condensing on the surfaces of the retainer rings when cooled off at the time of interruption of operation or of leaking water from the stator depositing on the surfaces of the retainer rings, causing a drop in resistance to stress corrosion cracking of the retainer rings.

In order to prevent the stress corrosion cracking of the retainer rings, there have been employed stress corrosion cracking resistant steel materials with various carbon contents like, for example, 12Mn-18Cr steel, which however all turned out to have a problem with regard to workability or strength.

SUMMARY OF THE INVENTION

It is an object of the present invention to provide a non-magnetic steel with good stress corrosion cracking resistance along with other properties which have been demanded of a material for the retainer rings of the generator rotor, precluding the problems of the conventional steels as mentioned hereinbefore.

It is a more particular object of the present invention to provide a high Mn-Cr non-magnetic steel which is free of stress corrosion cracking even in the environment of an aqueous solution and which has a magnetic permeability of less than 1.02 after cold working at a rate of about 50% and an yield strength greater than 110 kgf/mm$^2$ after cold working at rate of about 30%.

According to the present invention, there is provided a high Mn-Cr non-magnetic steel having good resistance to stress corrosion cracking, which consists essentially of the following elements in % by weight:

0.05–0.18% of carbon;
up to 1.0% of silicon;
16–25% of Manganese;
14–17% of chromium;
0–0.8% of vanadium;
0.3–0.6% of nitrogen;
0.06–0.3% of nickel; and the balance of iron and inevitable impurities.

The vanadium content in the above-defined steel is preferred to be in the range of 0.3–0.8% by weight, and the steel may further contain in total amount 0.1 to 1% by weight of at least one element selected from the group consisting of titanium, niobium and zirconium.

The above and other objects, features and advantages of the present invention will become apparent from the following description and appended claims, taken in conjunction with the accompanying drawings.

PARTICULAR DESCRIPTION OF THE INVENTION

Figure 2:
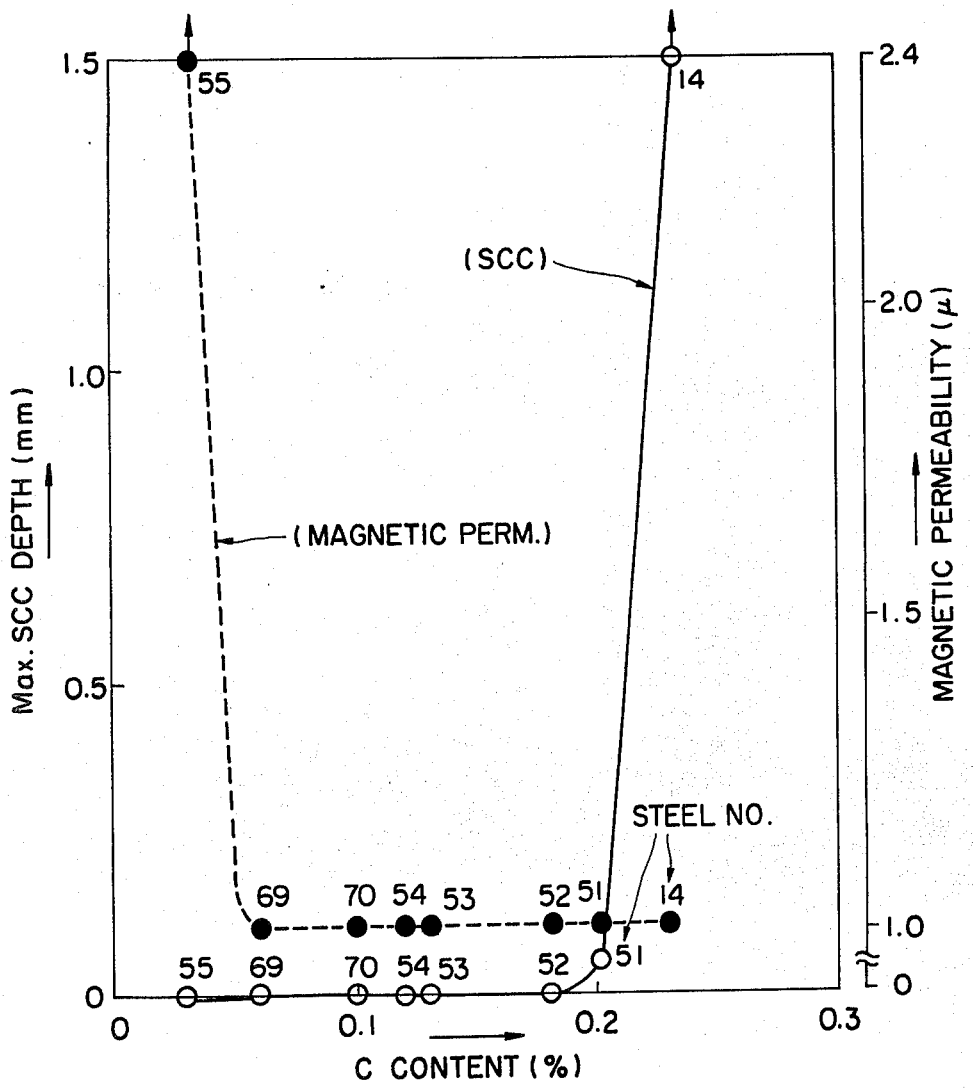
FIG. 2 is a graph showing the influence of C-content on the SCC resistance and magnetic permeability of 50% cold-worked material of 18Mn-15Cr-V-N steel.

With regard to the constituent elements of the high Mn-Cr steel according to the present invention and their proportions, the element C which contributes to impart strength to the steel should be contained in the range of 0.05–0.18% since the non-magnetic property of the steel becomes instable with a C-content less than 0.05% and the stress corrosion cracking is conspicuously increased with a C-content in excess of 0.18% as shown in FIG. 2. Thus, the above-defined upper and lower limits of the C-content are critical.

The element Si is necessary as a deoxidizing agent but its content should not exceed 1% because otherwise the workability of the steel will be deteriorated. Consequently, the Si-content should be up to 1% at most.

Figure 3:
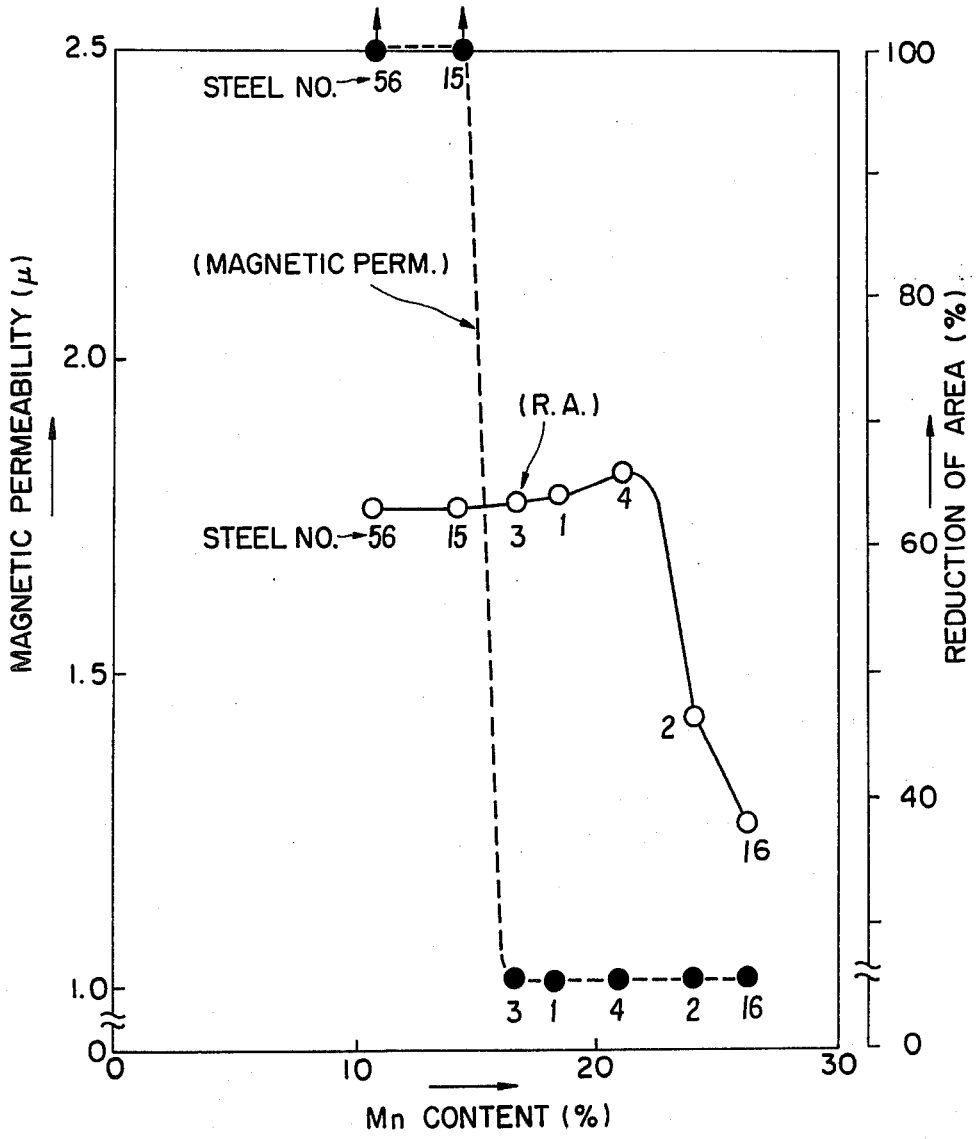
FIG. 3 is a graph showing the effect of Mn-content on the magnetic permeability of 50% cold-worked material and hot tensile (800° C.) fracture reduction of Cr-V-N steel.

The element Mn contributes to the stabilization of the non-magnetic property and should be contained in the range of 16–25%. As seen in FIG. 3, the non-magnetic property becomes instable with a Mn-content less than 16% but the hot workability is deteriorated considerably if its content is greater than 25%. It is to be noted that especially the just-mentioned lower limit of the Mn-content is critical.

Figure 4:
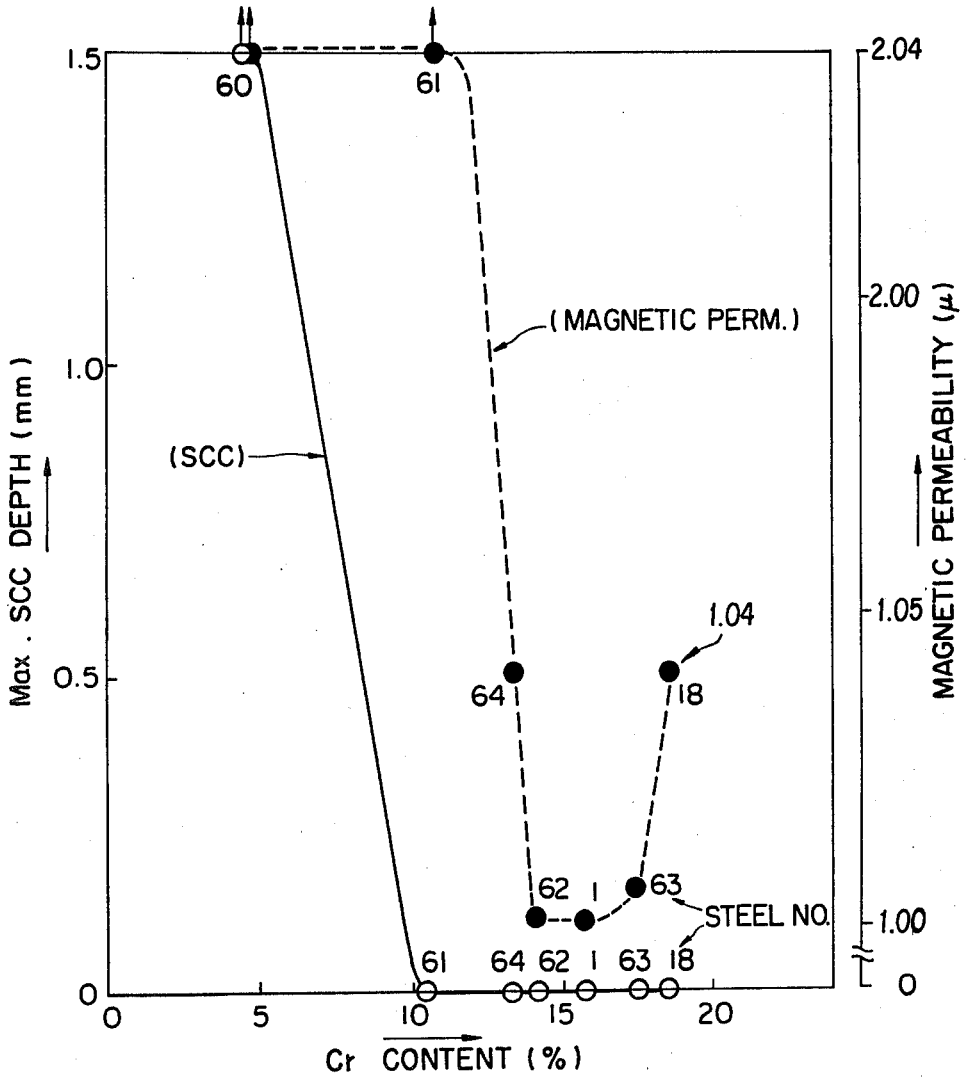
FIG. 4 is a graph showing the influence of Cr-content on the magnetic permeability and SCC resistance of 50% cold-worked material of 18Mn-V-N steel.

Turning now to the element Cr which contributes to the stabilization of the non-magnetic property similarly to Mn, it should be contained in the range of 14–17%. As shown in FIG. 4, the non-magnetic property becomes instable when the Cr-content is less than 14%, and a steel with a Cr-content less than 10% is susceptible to the stress corrosion cracking. On the other hand, a Cr-content in excess of 17% is reflected by instability in non-magnetic property. Thus, the above-mentioned upper and lower limits of the Cr-content are critical.

Figure 5:
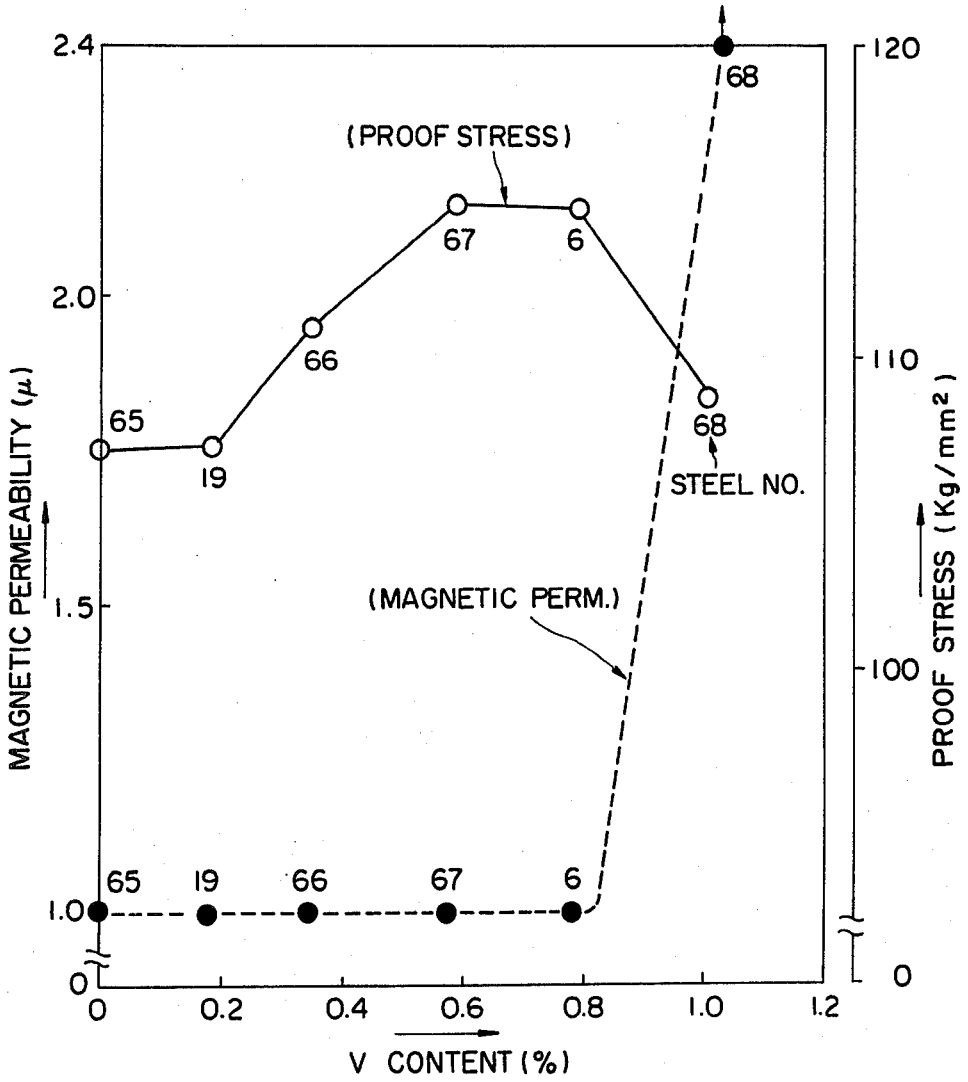
FIG. 5 is a graph showing the influence of V-content on the 0.2% yield strength of 30% cold-worked material and on the magnetic permeability of 50% cold-worked material of 18Mn-15Cr-N-0.13C steel.

With regard to the component V, the non-magnetic property of the steel becomes instable if its content exceeds 0.8% as seen in FIG. 5. Therefore, the V-content should be in the range of 0–0.8%. The element V has an effect of improving the strength of the steel but this effect cannot be produced in any practical degree when it is added less than 0.3%. Thus, the V-content is preferred to be in the range of 0.3–0.8%.

Figure 6:
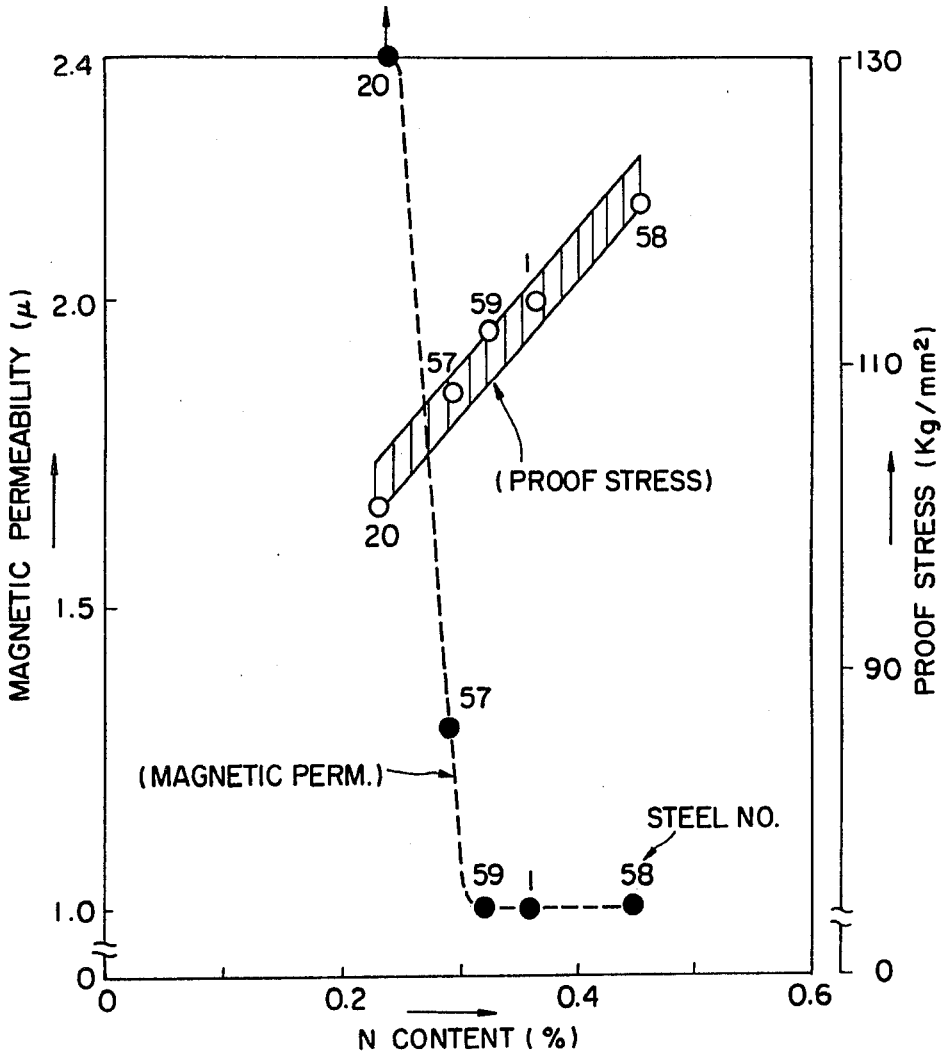
FIG. 6 is a graph showing the influence of N-content on the 0.2% yield strength of 30% cold-worked material and magnetic permeability of 50% cold-worked material of 18Mn-15Cr-0.5V steel.

The element N which has the effects of increasing the strength and stabilizing the non-magnetic property of the steel fails to produce these effects in a sufficient degree if its content is less than 0.3% as seen in FIG. 6, and gives rise to air bubbles in the steel ingots if it is added more than 0.6%, deteriorating the hot workability of the steel to a material degree. Consequently, the N-content should be in the range of 0.3–0.6%, of which the lower limit of 0.3% is especially critical.

Although the element Ni is necessary for stabilizing the non-magnetic property of the steel, it is desirable to reduce the costly Ni-content to as small an amount as possible and to add in the range of 0.06–0.3% in terms of the balance with the C- and N-contents which are also effective for the stabilization of the non-magnetic property.

The elements Ti, Nb and Zr contribute to make the crystalline grain size finer and therefore it is preferred to add at least one of these elements in an amount of 0.1–1% in total.

The high Mn-Cr non-magnetic steel according to the present invention is illustrated more particularly by the following examples.

EXAMPLE 1

Figure 1:
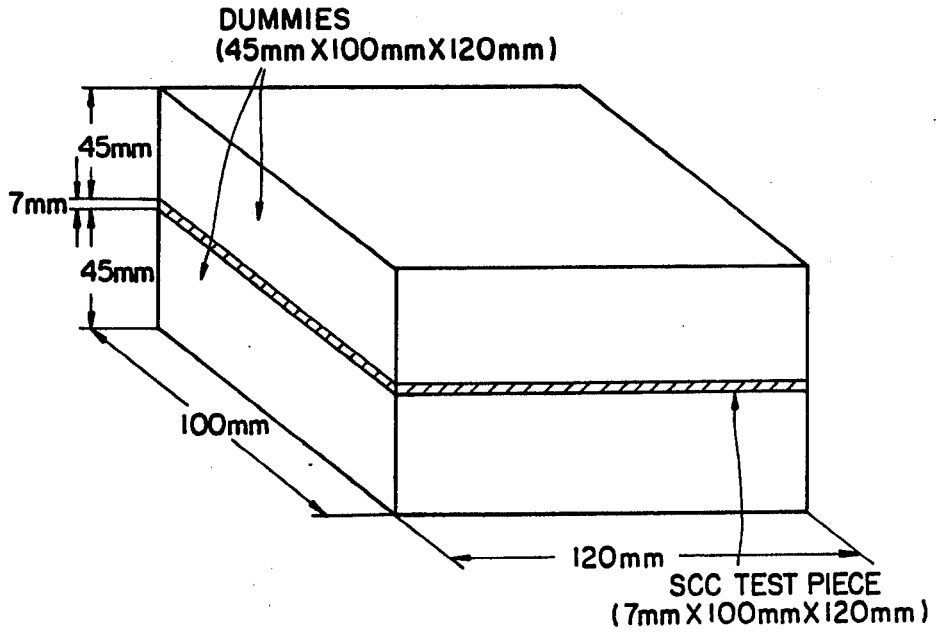
FIG. 1 is a sketch showing the shape and dimensions of a test piece in heat treatment prior to a SCC test.

Steels of the chemical compositions of Table 1 were smelted (50 kg each) by an ordinary method, and processed through casting, ingot making, hot forging and hot rolling according to usual procedures. The specimens of the shape and dimensions as shown in FIG. 1 were subjected to a heat treatment to heat each specimen at 1100° C. for 30 minutes followed by air cooling, and then to cold rolling of a reduction rate less than 50%, obtaining test pieces after machining.

TESTING METHODS (1) Stress corrosion cracking test: 70° C., 3% NaCl solution, U-bent test piece, 1-week immersion.

(2) Magnetic permeability: Measured at room temperature using a flat test piece.

(3) Tensile test: Measured at room temperature using a JIS 1B test piece.

(4) Hot workability: Rated by the presence or absence of cracking in hot forging and hot rolling and by the value of fracture reduction in hot tensile test at 800° C. using a JIS No. 4 D-type test piece.

The test results are shown in Table 2.

As clear from the test results, the high Mn-Cr non-magnetic steels according to the present invention were all free of stress corrosion cracking even in an aqueous solution, for example, in an aqueous solution of 3% NaCl, and showed a magnetic permeability smaller than 1.02 after cold working of about 50% and a 0.2% yield strength higher than 110 kgf/mm after cold working of about 30%. In contrast, the comparative steel No. 13 showed high magnetic permeability and cracking in rolling although it is free from stress corrosion cracking. The comparative steel No. 14 showed good magnetic permeability but suffered from stress corrosion cracking, and on the contrary the comparative steel No. 15 with no stress corrosion cracking was unsatisfactory in magnetic permeability and cracking in rolling. With regard to the comparative steel Nos. 16 and 21, it was impossible to sample a test piece due to cracking in hot forging. Of the comparative steel Nos. 17 to 20 which were free of the stress corrosion cracking, there were observed a large magnetic permeability in steel Nos. 17, 18 and 20, a conspicuously low 0.2% yield strength in steel Nos. 19 and 20, a marked stress corrosion cracking in steel Nos. 22 and 23, and an extremely low 0.2% yield strength and high magnetic permeability in steel No. 23.

Similarly, the steel Nos. 24 to 39 according to the present invention were free of stress corrosion cracking after immersion in a 3% NaCl solution, showing before and after the immersion a magnetic permeability less than 1.02 along with good 0.2% yield strength.

On the other hand, although the comparative steel No. 40 exhibited no stress corrosion cracking, it suffered from cracking in hot rolling, with a high magnetic permeability before and after the above-mentioned immersion test in the case of a 50% cold-worked test piece. The comparative steel No. 41 showed stress corrosion cracking and a high magnetic permeability after immersion in the solution, while the comparative steel No. 42 which was free of the stress corrosion cracking manifested a high magnetic permeability before and after the immersion. For the comparative steel No. 43, sampling of a test piece was impossible due to cracking in hot rolling. The comparative steel Nos. 44 to 46 were all safe from stress corrosion cracking but not from cracking in hot rolling, the steel Nos. 44 and 46 both showing a high magnetic permeability before and after immersion in the solution and a low 0.2% yield strength while the steel No. 45 showing a high magnetic permeability in all of the measurements. Regarding the comparative steel No. 47, it was impossible to sample a test piece due to cracking in hot forging. The comparative steel Nos. 48 and 49 were subject to stress corrosion cracking and high in magnetic permeability after immersion in the solution, with a low 0.2% yield strength. The comparative steel No. 50 was free of stress corrosion cracking but showed a high magnetic permeability after immersion in the solution and a lowest 0.2% yield strength.

TABLE 1 - A

| Steel | Chemical Composition (%) | | | | | | | | | | |
|---|---|---|---|---|---|---|---|---|---|---|---|
| No. | C | Si | Mn | P | S | Ni | Cr | V | N | Others | Remarks |
| 1 | 0.13 | 0.33 | 18.3 | 0.025 | 0.010 | 0.14 | 15.7 | 0.51 | 0.36 | — | Invention |
| 2 | 0.06 | 0.37 | 24.1 | 0.020 | 0.015 | 0.08 | 15.1 | 0.32 | 0.55 | — | " |

TABLE 1 - A-continued

| Steel No. | Chemical Composition (%) C | Si | Mn | P | S | Ni | Cr | V | N | Others | Remarks |
|---|---|---|---|---|---|---|---|---|---|---|---|
| 3 | 0.12 | 0.45 | 16.5 | 0.018 | 0.013 | 0.07 | 16.5 | 0.41 | 0.48 | — | " |
| 4 | 0.18 | 0.24 | 21.0 | 0.024 | 0.008 | 0.21 | 15.5 | 0.36 | 0.32 | — | " |
| 5 | 0.14 | 0.93 | 17.7 | 0.019 | 0.005 | 0.11 | 15.2 | 0.55 | 0.40 | — | " |
| 6 | 0.14 | 0.29 | 18.0 | 0.018 | 0.012 | 0.09 | 15.7 | 0.78 | 0.36 | — | " |
| 7 | 0.10 | 0.35 | 18.4 | 0.023 | 0.009 | 0.09 | 15.3 | 0.47 | 0.45 | Ti 0.37 | " |
| 8 | 0.11 | 0.34 | 18.3 | 0.022 | 0.010 | 0.10 | 15.3 | 0.45 | 0.44 | Nb 0.18 | " |
| 9 | 0.09 | 0.35 | 18.2 | 0.021 | 0.011 | 0.11 | 15.4 | 0.47 | 0.43 | Nb 0.57 | " |
| 10 | 0.10 | 0.33 | 18.1 | 0.024 | 0.012 | 0.08 | 15.2 | 0.46 | 0.42 | Nb 0.89 | " |
| 11 | 0.12 | 0.36 | 18.2 | 0.022 | 0.009 | 0.09 | 15.5 | 0.44 | 0.43 | Zr 0.14 | " |
| 12 | 0.13 | 0.40 | 18.0 | 0.021 | 0.008 | 0.10 | 15.6 | 0.41 | 0.45 | Nb 0.31 Zr 0.11 | " |
| 13 | 0.03 | 0.32 | 18.2 | 0.024 | 0.011 | 0.13 | 15.6 | 0.50 | 0.37 | — | Comparative |
| 14 | 0.23 | 0.31 | 18.4 | 0.023 | 0.009 | 0.13 | 15.5 | 0.52 | 0.39 | — | " |
| 15 | 0.13 | 0.44 | 14.1 | 0.018 | 0.012 | 0.08 | 16.7 | 0.40 | 0.47 | — | " |
| 16 | 0.12 | 0.45 | 26.3 | 0.019 | 0.014 | 0.07 | 16.6 | 0.41 | 0.46 | — | " |
| 17 | 0.18 | 0.23 | 20.4 | 0.023 | 0.007 | 0.20 | 13.3 | 0.35 | 0.33 | — | " |
| 18 | 0.18 | 0.25 | 17.7 | 0.024 | 0.010 | 0.18 | 18.5 | 0.34 | 0.32 | — | " |
| 19 | 0.15 | 0.30 | 17.8 | 0.017 | 0.011 | 0.08 | 15.5 | 0.18 | 0.38 | — | " |
| 20 | 0.13 | 0.35 | 19.4 | 0.017 | 0.008 | 0.15 | 15.1 | 0.41 | 0.23 | — | " |
| 21 | 0.14 | 0.36 | 19.2 | 0.017 | 0.009 | 0.13 | 15.3 | 0.40 | 0.72 | — | " |
| 22 | 0.51 | 0.33 | 19.4 | 0.023 | 0.010 | 0.10 | 5.1 | 0.43 | 0.22 | — | " |
| 23 | 0.42 | 0.39 | 18.5 | 0.025 | 0.008 | 0.08 | 2.2 | — | — | — | " |

TABLE 1 - B

| Steel No. | Chemical Composition (%) C | Si | Mn | P | S | Ni | Cr | N | Others | Remarks |
|---|---|---|---|---|---|---|---|---|---|---|
| 24 | 0.14 | 0.34 | 18.5 | 0.015 | 0.010 | 0.10 | 15.8 | 0.41 | — | Invention |
| 25 | 0.07 | 0.35 | 18.3 | 0.014 | 0.010 | 0.11 | 16.0 | 0.43 | — | " |
| 26 | 0.18 | 0.33 | 18.6 | 0.016 | 0.008 | 0.09 | 15.9 | 0.42 | — | " |
| 27 | 0.15 | 0.32 | 16.1 | 0.023 | 0.012 | 0.24 | 16.3 | 0.39 | — | " |
| 28 | 0.16 | 0.30 | 24.7 | 0.021 | 0.013 | 0.20 | 16.4 | 0.38 | — | " |
| 29 | 0.13 | 0.29 | 18.9 | 0.017 | 0.009 | 0.08 | 15.2 | 0.40 | — | " |
| 30 | 0.12 | 0.27 | 19.0 | 0.016 | 0.009 | 0.06 | 16.7 | 0.41 | — | " |
| 31 | 0.10 | 0.40 | 18.5 | 0.020 | 0.005 | 0.12 | 15.5 | 0.33 | — | " |
| 32 | 0.11 | 0.42 | 18.4 | 0.019 | 0.006 | 0.11 | 15.7 | 0.58 | — | " |
| 33 | 0.17 | 0.92 | 17.9 | 0.021 | 0.008 | 0.23 | 16.3 | 0.43 | — | " |
| 34 | 0.13 | 0.34 | 19.8 | 0.013 | 0.017 | 0.15 | 15.9 | 0.44 | Ti 0.48 | " |
| 35 | 0.14 | 0.35 | 20.6 | 0.015 | 0.013 | 0.20 | 16.2 | 0.41 | Nb 0.12 | " |
| 36 | 0.15 | 0.38 | 20.4 | 0.015 | 0.013 | 0.21 | 16.1 | 0.39 | Nb 0.37 | " |
| 37 | 0.14 | 0.38 | 20.3 | 0.014 | 0.013 | 0.21 | 16.0 | 0.40 | Nb 0.85 | " |
| 38 | 0.12 | 0.32 | 19.6 | 0.012 | 0.014 | 0.14 | 15.7 | 0.43 | Zr 0.45 | " |
| 39 | 0.11 | 0.33 | 19.9 | 0.013 | 0.014 | 0.13 | 15.9 | 0.42 | Ti 0.24, Zr 0.18 | " |
| 40 | 0.04 | 0.35 | 17.0 | 0.020 | 0.017 | 0.12 | 16.1 | 0.38 | — | Comparative |
| 41 | 0.25 | 0.37 | 17.1 | 0.021 | 0.018 | 0.13 | 16.2 | 0.37 | — | " |
| 42 | 0.13 | 0.32 | 15.3 | 0.022 | 0.008 | 0.28 | 16.7 | 0.43 | — | " |
| 43 | 0.12 | 0.33 | 27.0 | 0.023 | 0.007 | 0.29 | 16.6 | 0.45 | — | " |
| 44 | 0.10 | 0.29 | 18.3 | 0.021 | 0.008 | 0.15 | 14.0 | 0.33 | — | " |
| 45 | 0.09 | 0.28 | 18.4 | 0.022 | 0.010 | 0.13 | 19.0 | 0.34 | — | " |
| 46 | 0.07 | 0.41 | 18.8 | 0.019 | 0.007 | 0.08 | 16.1 | 0.18 | — | " |
| 47 | 0.06 | 0.43 | 18.9 | 0.018 | 0.006 | 0.09 | 16.2 | 0.77 | — | " |
| 48 | 0.51 | 0.33 | 19.4 | 0.023 | 0.010 | 0.10 | 5.1 | 0.22 | V 0.43 | " |
| 49 | 0.42 | 0.39 | 18.5 | 0.025 | 0.008 | 0.08 | 2.2 | — | — | " |
| 50 | 0.06 | 0.41 | 1.8 | 0.021 | 0.007 | 8.92 | 18.8 | 0.02 | — | " |

TABLE 2-A

| Steel No. | Test Results: Susceptivity to SCC Cold working rate (%) 0 | 30 | 50 | 0.24% Yield Strength (kgf/mm²) Cold working rate (%) 0 | 30 | 50 | Magnetic Permeability (o) Cold working rate (%) 0 | 30 | 50 | Hot Workability | Remarks |
|---|---|---|---|---|---|---|---|---|---|---|---|
| 1 | o | o | o | 45 | 114 | 134 | <1.01 | <1.01 | <1.01 | Good | Invention |
| 2 | o | o | o | 47 | 117 | 134 | <1.01 | <1.01 | <1.01 | " | " |
| 3 | o | o | o | 51 | 118 | 133 | <1.01 | <1.01 | <1.01 | " | " |
| 4 | o | o | o | 47 | 113 | 131 | <1.01 | <1.01 | <1.01 | " | " |
| 5 | o | o | o | 47 | 115 | 131 | <1.01 | <1.01 | <1.01 | " | " |
| 6 | o | o | o | 50 | 110 | 127 | 1.01 | <1.01 | 1.01 | " | " |
| 7 | o | o | o | 54 | 122 | 128 | <1.01 | <1.01 | <1.01 | " | " |
| 8 | o | o | o | 55 | 123 | 137 | <1.01 | <1.01 | <1.01 | " | " |
| 9 | o | o | o | 50 | 118 | 133 | <1.01 | <1.01 | <1.01 | " | " |
| 10 | o | o | o | 52 | 120 | 138 | <1.01 | <1.01 | <1.01 | " | " |
| 11 | o | o | o | 54 | 123 | 138 | <1.01 | <1.01 | <1.01 | " | " |
| 12 | o | o | o | 55 | 125 | 142 | <1.01 | <1.01 | <1.01 | " | " |
| 13 | o | o | o | 43 | 100 | 112 | 1.01 | 1.04 | >2.5 | Cracking in h. rolling | Comparative |
| 14 | x | x | x | 50 | 120 | 137 | <1.01 | <1.01 | <1.01 | Good | " |

TABLE 2-A-continued

| Steel No. | Susceptivity to SCC Cold working rate (%) 0 | 30 | 50 | Test Results: 0.24% Yield Strength (kgf/mm²) Cold working rate (%) 0 | 30 | 50 | Magnetic Permeability (o) Cold working rate (%) 0 | 30 | 50 | Hot Workability | Remarks |
|---|---|---|---|---|---|---|---|---|---|---|---|
| 15 | o | o | o | 47 | 115 | 129 | 1.01 | 1.05 | >2.5 | Cracking in h. rolling | " |
| 16** | — | — | — | — | — | — | — | — | — | Cracking in h. rolling | " |
| 17 | o | o | o | 47 | 109 | 124 | 1.01 | 1.04 | >2.5 | Good | " |
| 18 | o | o | o | 45 | 110 | 124 | 1.03 | 1.04 | 1.04 | " | " |
| 19 | o | o | o | 42 | 107 | 121 | <1.01 | <1.01 | <1.01 | " | " |
| 20 | o | o | o | 43 | 100 | 115 | 1.02 | >2.5 | >2.5 | " | " |
| 21** | — | — | — | — | — | — | — | — | — | Cracking in h. forging | " |
| 22 | x | x | x | 51 | 115 | 130 | <1.01 | 1.01 | 1.01 | Good | " |
| 23 | x | x | x | 49 | 107 | 121 | 1.02 | >2.5 | >2.5 | " | " |

*The marks "o" and "x" indicate absence and presence of SCC, respectively.
**Sampling of test pieces impossible due to cracking in hot forging.

TABLE 2-B

| Steel No. | Susceptivity to SCC Cold working rate (%) 0 | 50 | Magnetic Permeability (μo) Before immension (%) Cold working rate (%) 0 | 50 | After immension (%) Cold working rate (%) 0 | 50 | 0.2% Yield Strength (kgf/mm²) Cold working rate (%) 0 | 50 | Hot Workability | Remarks |
|---|---|---|---|---|---|---|---|---|---|---|
| 24 | o | o | <1.01 | <1.01 | <1.01 | <1.01 | 50 | 133 | Good | Invention |
| 25 | o | o | <1.01 | 1.01 | <1.01 | 1.01 | 45 | 129 | " | " |
| 26 | o | o | <1.01 | <1.01 | <1.01 | <1.01 | 52 | 137 | " | " |
| 27 | o | o | <1.01 | <1.01 | <1.01 | <1.01 | 49 | 135 | " | " |
| 28 | o | o | <1.01 | <1.01 | <1.01 | <1.01 | 50 | 136 | " | " |
| 29 | o | o | <1.01 | <1.01 | <1.01 | <1.01 | 48 | 135 | " | " |
| 30 | o | o | <1.01 | <1.01 | <1.01 | <1.01 | 47 | 133 | " | " |
| 31 | o | o | <1.01 | <1.01 | <1.01 | <1.01 | 45 | 129 | " | " |
| 32 | o | o | <1.01 | <1.01 | <1.01 | <1.01 | 55 | 139 | " | " |
| 33 | o | o | <1.01 | <1.01 | <1.01 | <1.01 | 55 | 139 | " | " |
| 34 | o | o | <1.01 | <1.01 | <1.01 | <1.01 | 55 | 141 | " | " |
| 35 | o | o | <1.01 | <1.01 | <1.01 | <1.01 | 55 | 140 | " | " |
| 36 | o | o | <1.01 | <1.01 | <1.01 | <1.01 | 54 | 138 | " | " |
| 37 | o | o | <1.01 | <1.01 | <1.01 | <1.01 | 55 | 142 | " | " |
| 38 | o | o | <1.01 | <1.01 | <1.01 | <1.01 | 54 | 136 | " | " |
| 39 | o | o | <1.01 | <1.01 | <1.01 | <1.01 | 53 | 135 | " | " |
| 40 | o | o | <1.01 | >2.5 | <1.01 | >2.5 | 42 | 125 | Cracking in h. rolling | Comparative |
| 41 | x | x | <1.01 | <1.01 | 1.04 | 1.04 | 51 | 130 | Good | " |
| 42 | o | o | <1.01 | 1.7 | <1.01 | 1.9 | 50 | 132 | " | " |
| 43 | — | — | — | — | — | — | — | — | Cracking in h. forging | " |
| 44 | o | o | <1.01 | >2.5 | <1.01 | >2.5 | 43 | 127 | Cracking in h. rolling | " |
| 45 | o | o | 1.04 | 1.04 | 1.04 | 1.04 | 42 | 125 | Cracking h. rolling | " |
| 46 | o | o | <1.01 | >2.5 | <1.01 | >2.5 | 37 | 117 | Cracking h. rolling | " |
| 47 | — | — | — | — | — | — | — | — | Cracking in h. forging | " |
| 48 | x | x | <1.01 | 1.01 | >2.5 | >2.5 | 51 | 130 | Good | " |
| 49 | x | x | 1.02 | >2.5 | >2.5 | >2.5 | 49 | 121 | " | " |
| 50 | o | o | <1.01 | >2.5 | <1.0 | >2.5 | 23 | 112 | " | " |

*The marks "o" and "x" indicate absence and presence of SCC, respectively.
**Sampling of test pieces impossible due to cracking in hot forging.

EXAMPLE 2

Steels of the chemical compositions shown in Table 3 were smelted and treated in the same manner as in Example 1 to obtain steel secimens and test pieces to examine the stress corrosion cracking, magnetic permeability, 0.2% yield strength and hot workability also accoridng to the same procedures as in Example 1.

The test results are plotted in FIGS. 2 to 6, from which it will be understood that particularly the upper and lower limits (0.18% and 0.05%) of the C-content, the lower limit (16%) of the Mn-content, the upper and lower limits (17% and 14%) of the Cr-contents and the lower limits (0.3%) of the N-content are critical in order to secure the steel properties as required by the retainer rings of generator rotors.

It will be appreciated from foregoing test results that the high Mn-Cr non-magnetic steel according to the present invention is satisfactory in all of the properties which are required of a material for the retainer ring of the generator rotor, in contrast to the comparative steels which fail to meet the required properties.

TABLE 3

| Steel No. | Chemical Composition C | Si | Mn | P | S | Ni | Cr | V | N |
|---|---|---|---|---|---|---|---|---|---|
| 51 | 0.20 | 0.32 | 18.4 | 0.024 | 0.012 | 0.15 | 15.6 | 0.50 | 0.31 |
| 52 | 0.18 | 0.24 | 18.5 | 0.024 | 0.010 | 0.21 | 15.5 | 0.37 | 0.34 |
| 53 | 0.13 | 0.35 | 18.4 | 0.023 | 0.009 | 0.09 | 15.3 | 0.47 | 0.45 |

TABLE 3-continued

| Steel No. | Chemical Composition C | Si | Mn | P | S | Ni | Cr | V | N |
|---|---|---|---|---|---|---|---|---|---|
| 54 | 0.12 | 0.24 | 18.0 | 0.024 | 0.008 | 0.21 | 15.5 | 0.36 | 0.32 |
| 55 | 0.03 | 0.32 | 18.2 | 0.024 | 0.011 | 0.13 | 15.6 | 0.51 | 0.37 |
| 56 | 0.13 | 0.46 | 10.4 | 0.017 | 0.004 | 0.08 | 15.6 | 0.51 | 0.37 |
| 57 | 0.14 | 0.59 | 18.2 | 0.006 | 0.005 | 0.13 | 14.7 | 0.42 | 0.29 |
| 58 | 0.12 | 0.54 | 18.4 | 0.018 | 0.003 | 0.16 | 15.5 | 0.57 | 0.45 |
| 59 | 0.13 | 0.51 | 18.4 | 0.017 | 0.004 | 0.15 | 15.6 | 0.52 | 0.32 |
| 60 | 0.14 | 0.34 | 18.2 | 0.024 | 0.010 | 0.21 | 5.2 | 0.43 | 0.34 |
| 61 | 0.15 | 0.33 | 18.4 | 0.024 | 0.008 | 0.22 | 10.5 | 0.41 | 0.35 |
| 62 | 0.13 | 0.35 | 18.3 | 0.025 | 0.009 | 0.21 | 14.1 | 0.42 | 0.37 |
| 63 | 0.13 | 0.34 | 18.1 | 0.024 | 0.011 | 0.21 | 17.5 | 0.43 | 0.35 |
| 64 | 0.14 | 0.23 | 18.4 | 0.023 | 0.007 | 0.20 | 13.3 | 0.35 | 0.33 |
| 65 | 0.13 | 0.46 | 18.2 | 0.012 | 0.004 | 0.09 | 15.6 | — | 0.323 |
| 66 | 0.13 | 0.35 | 18.4 | 0.015 | 0.013 | 0.09 | 15.6 | 0.34 | 0.37 |
| 67 | 0.12 | 0.54 | 18.4 | 0.018 | 0.003 | 0.07 | 15.5 | 0.57 | 0.45 |
| 68 | 0.13 | 0.51 | 18.2 | 0.017 | 0.004 | 0.08 | 15.4 | 1.06 | 0.35 |
| 69 | 0.06 | 0.37 | 18.7 | 0.020 | 0.015 | 0.08 | 15.1 | 0.32 | 0.35 |

TABLE 3-continued

| Steel No. | Chemical Composition C | Si | Mn | P | S | Ni | Cr | V | N |
|---|---|---|---|---|---|---|---|---|---|
| 70 | 0.10 | 0.45 | 18.3 | 0.018 | 0.013 | 0.07 | 16.5 | 0.41 | 0.38 |

What is claimed is:

1. A high Mn-Cr non-magnetic steel having good resistance to stress corrosion cracking and having a magnetic permeability which is uniformly less than 1.02, which consists essentially of the following elements in percentage by weight: 0.05–0.18% of carbon; up to 1.0% of silicon; 16–25% of manganese; 14–17% of chromium; 0–0.8% of vanadium; 0.3–0.6% of nitrogen; 0.06–0.3% of nickel; and the balance of iron and inevitable impurities.

2. The steel as set forth in claim 1, wherein the vanadium content in said steel is in the range of 0.3–0.8% by weight.

3. The steel as set forth in claim 1 or 2, wherein said steel contains in total 0.1–1% by weight of at least one element selected from the group consisting of titanium, niobium and zirconium.

* * * * *

UNITED STATES PATENT AND TRADEMARK OFFICE

CERTIFICATE OF CORRECTION

PATENT NO. : 4,481,033

DATED : November 6, 1984

INVENTOR(S) : Fujiwara et al

It is certified that error appears in the above-identified patent and that said Letters Patent is hereby corrected as shown below:

In Abstract, line 8, please insert ";" after vanadium.

Column 1, line 67, delete "an" and insert --a--.

Column 2, line 7, delete "Manganese" and insert --manganese--.

Column 2, line 27, delete "a SCC" and insert --an SCC--.

Column 4, line 12, delete "110 kgf/mm" and insert --110 kgf/$mm^2$--.

Column 7, line 59, delete "secimens" and insert --specimens--.

Column 7, line 62, delete "accoridng" and insert --according--.

Column 5, line 14 of chart, under N, delete "0.39" and insert --0.35--.

UNITED STATES PATENT AND TRADEMARK OFFICE

CERTIFICATE OF CORRECTION

PATENT NO. : 4,481,033

DATED : November 6, 1984

INVENTOR(S) : Fujiwara et al

It is certified that error appears in the above-identified patent and that said Letters Patent is hereby corrected as shown below:

Column 7, column heading in Table 2-B, delete "Before immension" and insert --Before immersion--.

Column 7, column heading in Table 2-B, delete "After immension" and insert --After immersion--.

Column 8, under Table 2-B, (Steel No.) lines 45 and 46 under Hot Workability, delete "Cracking h. rolling" and insert --Cracking in h. rolling--.

Column 9, Table 3, (Steel No.) line 65 under Cr, please delete "15.6" and insert --15.8--.

Signed and Sealed this

*First* Day of *October 1985*

[SEAL]

*Attest:*

*Attesting Officer*

DONALD J. QUIGG

*Commissioner of Patents and Trademarks—Designate*